US011230407B2

(12) United States Patent
Chatelain

(10) Patent No.: US 11,230,407 B2
(45) Date of Patent: Jan. 25, 2022

(54) CONTAINER FOR CONSUMER GOODS INCLUDING DISPENSING MEANS

(71) Applicant: Philip Morris Products S.A., Neuchâtel (CH)

(72) Inventor: Lucas Chatelain, Lausanne (CH)

(73) Assignee: Philip Morris Products S.A., Neuchâtel (CH)

( * ) Notice: Subject to any disclaimer, the term of this patent is extended or adjusted under 35 U.S.C. 154(b) by 0 days.

(21) Appl. No.: 16/761,081

(22) PCT Filed: Nov. 16, 2018

(86) PCT No.: PCT/EP2018/081646
§ 371 (c)(1),
(2) Date: May 1, 2020

(87) PCT Pub. No.: WO2019/097028
PCT Pub. Date: May 23, 2019

(65) Prior Publication Data

US 2020/0354104 A1 Nov. 12, 2020

(30) Foreign Application Priority Data

Nov. 17, 2017 (EP) ..... 17202444

(51) Int. Cl.
*B65D 5/72* (2006.01)
*B65D 5/18* (2006.01)
(Continued)

(52) U.S. Cl.
CPC ..... *B65D 5/724* (2013.01); *B65D 5/18* (2013.01); *B65D 5/48024* (2013.01); *B65D 85/1009* (2013.01)

(58) Field of Classification Search
CPC . B65D 5/724; B65D 5/18; B65D 5/72; B65D 85/1009; B65D 5/48024;
(Continued)

(56) References Cited

U.S. PATENT DOCUMENTS 2,556,707 A * 6/1951 Rendall ..... B65D 5/722 229/121
2,811,247 A 10/1957 Stevenson
(Continued)

FOREIGN PATENT DOCUMENTS

EP 2 331 414 B1 11/2013
EP 2 403 765 B1 11/2013
(Continued)

OTHER PUBLICATIONS

International Search Report and Written Opinion dated Jan. 24, 2019 in PCT/EP2018/081646 filed Nov. 16, 2018.
(Continued)

*Primary Examiner* — Steven A. Reynolds
(74) *Attorney, Agent, or Firm* — Oblon, McClelland, Maier & Neustadt, L.L.P.

(57) ABSTRACT

A container for consumer goods is provided, including a box to house the consumer goods, a top face of the box being open to provide a top access opening to access an interior of the box, a first box side wall including a side opening proximate the box bottom wall; a lid hingedly connected to the box back wall and movable between a closed lid position in which the lid covers the top access opening and an open lid position in which the top access opening is uncovered; and a dispenser including a tray portion to hold consumer goods and being mounted inside the box and slidable through the side opening between a closed position in which the tray portion is inside the box and a dispensing position
(Continued)

in which a part of the tray portion protrudes through the side opening such that the consumer goods are removable.

14 Claims, 4 Drawing Sheets

(51) Int. Cl.
*B65D 5/49* (2006.01)
*B65D 85/10* (2006.01)

(58) Field of Classification Search
CPC ..... B65D 5/722; B65D 85/10; B65D 85/20; B65D 5/721; A24F 15/06; A24F 15/16
USPC ..... 206/249
See application file for complete search history.

(56) References Cited

U.S. PATENT DOCUMENTS 2,875,938 A 3/1959 Bramhill
2,965,264 A * 12/1960 Silvia ..... B65D 5/722 221/257
4,709,811 A 12/1987 Shimada
2002/0074248 A1 6/2002 Venable
2009/0255839 A1* 10/2009 Erickson ..... A61M 5/3205 206/366
2011/0147242 A1* 6/2011 Superti ..... B65D 5/722 206/250
2015/0368019 A1* 12/2015 Pinkstone ..... B65D 5/743 229/117.3

FOREIGN PATENT DOCUMENTS

FR 2495444 A1 6/1982
GB 679 628 A 9/1952
GB 1036133 7/1966
RU 2 569 250 C1 11/2015
WO 2017/076481 A1 5/2017
WO WO 2017/108716 A1 6/2017
WO 2017/187370 A1 11/2017

OTHER PUBLICATIONS

Russian Decision to Grant and Search Report dated Oct. 22, 2021 in corresponding Russian Patent Application No. 2020117391 (with English translation), 19 pages.

* cited by examiner

CONTAINER FOR CONSUMER GOODS INCLUDING DISPENSING MEANS

The present invention relates to a container for consumer goods having improved means for dispensing the consumer goods. Containers according to the invention find particular application as containers for aerosol-generating articles or components of aerosol-generating articles.

It is known to package aerosol-generating articles and other consumer goods in containers formed from folded laminar blanks. Consumer goods are commonly sold in containers having a box for housing the consumer goods and a lid connected to the box about a hinge line extending across a wall of the container. Such packs are typically constructed from laminar cardboard blanks. The lid may take the form of a lid flap or a three dimensional hinge lid. In use, the lid is pivoted about the hinge line to open the pack and expose an access opening in the box, through which the consumer can gain access to the consumer goods held within the box.

In order to remove an aerosol-generating article from one of these known containers, the consumer must first open the lid and then draw an aerosol-generating article from the bundle of aerosol-generating articles housed within the container. Typically, the aerosol-generating articles will be arranged vertically within the container, with their ends directed towards the access opening. Since the aerosol-generating articles are typically all of the same length and positioned at the same height, the removal of a single aerosol-generating article from the container without also contacting the other smoking articles around it may be difficult, in particular when the container is relatively full.

It has been previously proposed to provide a container with means for lifting a single aerosol-generating article away from the remaining bundle so that the aerosol-generating article can be more readily grasped by the consumer and removed from the container. However, in such arrangements, all of the aerosol-generating articles within the container are still typically exposed upon opening of the container. In addition, it can be more difficult to eject an aerosol-generating article as the container becomes emptier, since an aerosol-generating article may not automatically be positioned on the lifting means. The means for lifting are also typically only adapted for use with containers in which the aerosol-generating article are arranged vertically and would not be suitable for containers in which the aerosol-generating articles are instead arranged transversely across the container.

It would be desirable to provide a container having novel dispensing means for conveniently dispensing one or more consumer goods. It would be particularly desirable to provide such novel dispensing means that enables the remaining consumer goods to stay protected inside the container until they are dispensed. It would be further desirable to provide such novel dispensing means which can be readily incorporated into an existing container design, without the need for significant structural modification of the container.

According to the invention there is provided a container for consumer goods, the container comprising: a box for housing the consumer goods, the box comprising a box front wall, a box back wall, a box bottom wall, a first box side wall and a second box side wall, wherein the top face of the box is at least partially open to provide a top access opening for accessing the interior of the box and wherein the first box side wall comprises a side opening proximate the box bottom wall; a lid hingedly connected to the box back wall and movable between a closed lid position in which the lid covers the top access opening and an open lid position in which the top access opening is uncovered; and a dispensing means for dispensing one or more consumer goods from the container. The dispensing means comprises a tray portion for holding one or more consumer goods, the tray portion being mounted inside the box such that the tray portion is slidable through the side opening in the first box side wall between a closed position, in which the tray portion is inside the box, and a dispensing position, in which a part of the tray portion protrudes through the side opening such that the one or more consumer goods within the tray portion can be removed.

The invention in particular provides a container for consumer goods, the container comprising: a box for housing the consumer goods, the box comprising a box front wall, a box back wall, a box bottom wall, a first box side wall and a second box side wall, wherein the top face of the box is at least partially open to provide a top access opening for accessing the interior of the box and wherein the first box side wall comprises a side opening proximate the box bottom wall; a lid hingedly connected to the box back wall and movable between a closed lid position in which the lid covers the top access opening and an open lid position in which the top access opening is uncovered; and a dispensing means for dispensing one or more consumer goods from the container, the dispensing means comprising a tray portion for holding one or more consumer goods, the tray portion being mounted inside the box such that the tray portion is slidable through the side opening in the first box side wall between a closed position, in which the tray portion is inside the box, and a dispensing position, in which a part of the tray portion protrudes through the side opening such that the one or more consumer goods within the tray portion can be removed, wherein the tray portion comprises a tray bottom wall and a hinge line provided on the tray bottom wall, the hinge line extending between a front edge and a back edge of the tray bottom wall and wherein in the dispensing position, the hinge line is outside of the box such that an end part of the tray bottom wall protruding through the side opening can be pivoted in a downwards direction relative to the box.

In the following description of the invention the terms "side", "top", "bottom", "front", "back" and other terms used to describe relative positions of the components of containers according to the invention refer to the container in an upright position with the top access opening at the top. When describing containers according to the present invention, these terms are used irrespective of the orientation of the container being described. The "bottom" of the container refers to the side of the container opposite the "top" of the container. The "back" of the container refers to the side towards which the lid swings open.

The term "height" is used herein to refer to dimensions extending between the top and the bottom. The term "width" is used herein to refer to dimensions extending between two sides. The term "depth" is used herein to refer to dimensions extending between the front and the back. Height, width and depth are orthogonal to each other.

The term "panel" is used herein to refer to a portion of the container formed from a single, continuous portion of material. A panel may depend from one or more other panels. The term "flap" refers to a panel that depends from only one other panel.

The term "wall" refers more generally to a facet of the container, and a wall may be formed from a single panel or flap, or a wall may be formed from two or more abutting or overlapping panels or flaps.

The term "depending" is used herein to describe a physical connection between two elements of a container in accordance with the invention. In more detail, the term "depending" is used to indicate that there is a material continuity between two elements, such as two walls or panels of a container or blank. This encompasses both cases wherein a wall or panel depends directly from an adjacent wall or panel as well as cases wherein an intermediate wall or panel effectively connects two walls or panels.

By way of example, a side wall or panel may depend directly from an adjacent front wall or panel. In such case, the wall or panel typically depends along a line of weakness from the adjacent wall. As an alternative, especially in containers having curved or bevelled edges, a side wall or panel may depend indirectly from a front wall or panel. In such case a curved or bevelled edge wall or panel connects the side wall or panel and the front wall or panel. In the case of a bevelled edge, both side wall or panel and front wall or panel may depend from the connecting bevelled edge wall or panel along respective fold lines. This also applies to optional components of containers in accordance with the invention, for example to a reinforcing member provided in the form of an inner frame.

The term "fold line" is used herein to describe any line of a blank about which the blank is folded. The fold line may be defined by a line of weakness to assist with the folding action. Alternatively, a fold can be formed without the presence of a weakening line, depending for example on the pliability of the blank material and other material characteristics.

The term "hinge line" is used herein to refer to a line about which a component of the container may pivot relative to another component. For example, the container comprises a hinge line which is the line about which the lid may be pivoted in order to open the container. A hinge line may also be provided in the dispensing means such that a portion of the dispensing means can be pivoted away from the consumer goods after dispensing, as described below. A hinge line may be, for example, a fold line or a score line.

The term "tray portion" is used herein to describe a component of the dispensing means that provides a substantially flat platform or support surface for supporting the one or more consumer goods to be dispensed and which typically provides a raised edge or rim extending at least part way around the support surface to prevent the consumer goods from sliding off the support surface. The tray portion is open at the top end so that the one or more consumer goods can be readily removed from the flat surface when the tray portion is outside of the box.

Containers according to the present invention comprise a dispensing means which is adapted so that one or more consumer goods can be dispensed through the side opening of the box simply by pulling the tray portion outwards from the box. The dispensing means is provided separately from the top access opening so that the top access opening can be used independently. This may advantageously enable the top access opening to be used for a different purpose, for example, to fill the container, or to access a separate compartment of the box as described below.

The dispensing means of the containers according to the present invention is provided towards the bottom end of the container so that it can be automatically refilled with one or more consumer goods after consumer goods have been dispensed. This is because the remaining consumer goods will automatically drop towards the bottom of the container as a result of gravity. Advantageously, the consumer therefore does not need to manipulate the container in order to refill the dispensing means between uses.

The dispensing means can be readily incorporated into an existing container with only a minor modification required to provide the side opening in a first side wall. The dispensing means can therefore advantageously be incorporated into a container without affecting the external appearance or shape of the container.

As described in more detail below, the containers of the present invention find particular application as containers for heated aerosol-generating articles that are adapted to be used with an aerosol-generating device comprising a heater element. The dispensing of an individual aerosol-generating article by the dispensing means of the present invention enables the aerosol-generating article to be received in the heating chamber of an aerosol-generating device in a contactless manner. This means that the consumer does not need to touch the aerosol-generating article at all, but can simply insert the dispensed aerosol-generating article directly from the container into the aerosol-generating device. The insertion of the aerosol-generating article into the aerosol-generating device can therefore be done simply and conveniently in a single contactless step, with the container in one hand and the aerosol-generating device in the other hand.

As described above, containers according to the present invention comprise a box having a top access opening at the top end and an additional side opening in the first side wall. The top access opening is closed by the lid, which is hingedly connected to the box back wall. The side opening is provided so that the tray portion of the dispensing means can move out from inside the box into a dispensing position. In the dispensing position, the tray portion with one or more consumer goods supported on it protrudes through the side opening and the one or more dispensed consumer goods can be easily removed from the container. This can be achieved without exposing the remaining consumer goods within the container.

As described above, the dispensing means comprises a tray portion which holds the one or more consumer goods to be dispensed. The tray portion preferably comprises a tray bottom wall, which provides the flat support surface for supporting the consumer goods to be dispensed and moving those consumer goods out through the side opening. The tray portion preferably further comprises one or more walls extending upwards from the tray bottom wall to prevent the consumer goods from sliding or rolling off the tray bottom wall as the tray portion moves into and out of the box during use. The height of the one or more walls extending upwards from the tray bottom wall may be adapted depending on the dimensions of the consumer goods to be retained on the tray portion. The one or more walls extending upwards may have a height that corresponds approximately to the height of the one or more consumer goods to be dispensed, or the height of the walls may be smaller or greater than the height of the consumer goods. The height of the one or more walls extending upwards may be substantially constant or may vary along the length of the walls.

In particularly preferred embodiments of the invention, the tray portion of the dispensing means is provided with a hinge line extending between a front edge and a back edge of the tray portion, wherein in the dispensing position, the hinge line is outside of the box such that an end part of the tray portion protruding through the side opening can be pivoted in a downwards direction relative to the box. The hinge line is therefore disposed in a position between a front edge and a back edge of the tray portion, more specifically between a front edge and a back edge of a tray bottom wall.

The hinge line is therefore preferably provided on a tray bottom wall of the tray portion. The hinge line extends across the tray bottom wall, preferably from a first side edge of the tray bottom wall to a second side edge of the tray bottom wall. Thus, in embodiments, the hinge line divides the tray bottom wall into at least two portions; a first tray bottom wall portion and a second tray bottom wall portion. The first tray bottom wall portion may be the end part of the tray portion protruding through the side opening, which can be pivoted in a downwards direction relative to the box, when the tray portion is in the dispensing position. The second tray bottom wall portion may remain entirely within the box when the tray portion is in the dispensing position. Alternatively, part of the second tray bottom wall portion may extend through the side opening of the box when the tray portion is in the dispensing position.

The first tray bottom wall portion may have the same width as the a second tray bottom wall portion. The first tray bottom wall portion preferably has a shorted length than the second tray bottom wall portion.

Where the tray portion comprises a tray front wall or a tray back wall extending upwards from the tray bottom wall, the tray front wall and the tray back wall are preferably arranged to terminate at or before the hinge line, or a cut is provided in each wall so that the walls can be split into two parts as the end part of the tray portion pivots downwards.

The provision of such a hinge line in the tray portion means that once the tray portion is in the dispensing position, the end part of the tray portion can be pivoted downwards and away from the protruding consumer goods. This may advantageously improve access to the consumer goods since the end part of the tray portion will no longer block the consumer goods on any side. The consumer can therefore grasp the one or more consumer goods more easily in order to remove them from the container.

This arrangement of the tray portion to incorporate a hinge line is particularly advantageous when the container of the present invention is used to house heated aerosol-generating articles. The pivoting of the end part of the tray portion in a downwards direction relative to the box moved the end part of the tray portion away from the protruding portion of the aerosol-generating article that has been dispensed. The end of the aerosol-generating article that has been dispensed is therefore fully exposed so that the aerosol-generating article can be inserted directly into an aerosol-generating device. In particular, the aerosol-generating device can be brought towards the end of the aerosol-generating article protruding from the box and the protruding end can be inserted into the heating chamber of the aerosol-generating device by pushing the aerosol-generating device towards the side opening. The presence of the aerosol-generating device adjacent the side opening prevents the end part of the tray portion from pivoting back upwards towards the box during the process of inserting the aerosol-generating article into the aerosol-generating device.

The insertion of the aerosol-generating article into the aerosol-generating device can therefore advantageously be carried out in a contactless manner without the consumer needing to first remove the aerosol-generating article from the container, or even touch the aerosol-generating article.

Preferably, the tray portion comprises a first tray side wall which substantially covers the side opening in the first side wall of the box when the tray portion is in the closed position. The size and shape of the tray side wall are therefore preferably adapted to substantially correspond to the size and shape of the side opening. In this way, the tray side wall will lie substantially flush to the first box side wall when the tray portion is in the closed position, so that the overall shape and appearance of the container is not significantly affected by the presence of the dispensing means. The covering of the side opening by the tray side wall also advantageously helps to ensure that the freshness of the consumer goods within the box is retained.

Alternatively or in addition, the tray portion preferably comprises a second tray side wall at the side of the tray portion that is opposite the side opening, wherein in the open position of the dispensing means the second tray side wall remains inside the box to restrict movement of the one or more consumer goods on the tray portion of the dispensing means back into the box. The presence of the second side wall advantageously prevents the one or more consumer goods supported on the tray portion from moving back into the box when the tray portion is in the dispensing position. This may be particularly advantageous when the container is used to house aerosol-generating articles for insertion into an aerosol-generating device, as described above. The presence of the second side wall will restrict and preferably substantially prevent the movement of the dispensed aerosol-generating article back inside the box during the insertion of the aerosol-generating article into the aerosol-generating device.

The tray portion is slidable in a sideways direction relative to the box between the closed position and the dispensing position in which the tray portion protrudes through the side opening in the first box side wall. Preferably, in the dispensing position, the tray portion protrudes through the side opening by a distance corresponding to at least a third of the width of the container, so that a sufficient portion of the consumer goods is exposed to enable the consumer goods to be readily removed from the tray portion.

In the closed position, the tray portion is preferably substantially fully inside the box so that only a tray side wall is visible through the side opening and the tray portion does not protrude through the side opening.

Preferably, the tray portion is mounted within the box such that the tray portion slides along the inner surface of the box bottom wall and the side opening of the box is provided at the bottom end of the first box side wall. In such embodiments, the tray portion is supported by the box bottom wall and the box bottom wall defines the line of movement of the tray portion. In other embodiments, suitable guide means may be incorporated into the interior of the box for the tray portion to slide along.

The tray portion may have a depth that substantially corresponds to the internal depth of the box, which is the internal distance between the box front wall and the box back wall. The side opening must therefore also extend across the full depth of the container. Alternatively, the tray portion may have a depth that is less than the internal depth of the box. The depth of the tray portion may be selected depending upon the dimensions of the consumer goods that are contained within the box.

Preferably, the dispensing means of containers according to the invention further comprise retention means for preventing the movement of the tray portion beyond the dispensing position. The retention means prevent the consumer from pull the tray portion out too far from the box and from unintentionally removing the tray portion from the box. The retention means provide the further function of defining the optimal dispensing position and allowing the consumer to easily move the tray portion directly into the dispensing position.

The retention means may be integrated into the walls of the tray portion. For example, in one preferred embodiment, the tray portion comprises a tray front wall and a tray back wall, wherein at least one of the tray front wall and the tray back wall comprises an increased height portion having a height that is larger than the height of the side opening. The increased height portion moves towards the first box side wall as the tray portion is moved towards the dispensing position and the increased height portion abuts the first box side wall when the tray portion reaches the dispensing position to prevent the movement of the tray portion beyond the dispensing position. Preferably, both the tray front wall and the tray back wall comprise an increased height portion.

Preferably, the or each increased height portion extends no more than two thirds of the way across the width of the tray portion from the second side wall opposite the side opening to enable at least a third of the tray portion to project through the side opening. Where the tray portion comprises a hinge line as described above, the or each increased height portion should terminate before the hinge line so that the movement of the hinge line outside of the box is not prevented.

Alternatively or in addition to the provision of an increased height portion on at least one of the tray front wall or tray back wall, other forms of retention means may be incorporated into the tray portion. For example, the tray portion may comprise an additional flap or tab that protrudes from the tray portion and abuts or with a corresponding flap or tab in the inner surface of the box as the tray portion moved into the dispensing position. The resulting locking of the flaps or tabs prevents further movement of the tray portion in an outward direction from the box.

Alternatively or in addition to any retention means provided within the container, closure means may be provided for retaining the tray portion of the dispensing means in the closed position between uses. For example, closure means may be provided to lock the tray portion in the closed position until a force of sufficient size is applied by the consumer. Alternatively, means may be provided to increase the friction between the tray portion and the inner surface of the box so that the tray portion is prevented from sliding relative to the box until the consumer applies a sufficient force to pull it through the side opening.

Preferably, the dispensing means of containers according to the present invention further comprises a pull tab extending from the tray portion such that in the closed position of the tray portion, the pull tab extends outwardly through the side opening. The pull tab provides a convenient means for the consumer to grasp the tray portion and pull it outwards from the closed position into the dispensing position. Alternatively or in addition to a pull tab, a cut out may be provided in the second side wall, opposite the side opening, so that the tray portion can be pushed outwards through the side opening, towards the dispensing position.

The dispensing means of container according to the present invention is preferably adapted to dispense an individual consumer good. This may be achieved by adapting the dimensions of the tray portion so that only one consumer good at a time can be supported and moved along with the tray portion. Alternatively or in addition, the dimensions of the side opening in the first box side wall may be adapted such that the side opening is only sufficiently large for a single consumer good to be dispensed at a time.

The dispensing means is preferably formed from a single laminar blank, which is folded to define the tray portion. Preferably, the laminar blank for forming the dispensing means is formed from the same sheet material as the box. Alternatively, the laminar blank for forming the dispensing means may be formed from a different material to the box.

Containers according to the present invention may further comprise a separator element mounted within the box, wherein the separator element separates the internal volume of the box into an upper compartment which is accessible through the top access opening and a lower compartment containing the consumer goods, wherein the consumer goods are dispensed from the lower compartment by means of the dispensing means.

The separator element is therefore incorporated inside the box of containers according to the invention in order to define separate compartments within the box. The upper compartment defined above the separator element is separate from the lower compartment from which the consumer goods are dispensed. The upper compartment can therefore advantageously be used as a waste compartment to store used consumer goods, such as used aerosol-generating articles. Alternatively, the upper compartment can be used to store the same or alternative consumer goods to those provided in the lower compartment, but which are separately accessible to the consumer through the top access opening.

The separator element is preferably slidable within the box to adjust the relative volumes of the upper compartment and the lower compartment. The separator element is therefore preferably mounted within the box such that it can slide upwards and downwards inside the box. In this way, the size of the lower compartment can be reduced as the consumer goods are emptied from the container and the upper compartment will increase in size, which may be useful for containers in which the upper compartment is intended for storage of used consumer goods.

Preferably, where the upper compartment is intended for storage of used consumer goods, the separator element automatically slides downwards to adjust the relative volumes of compartments as used consumer goods are inserted into the upper compartment. Alternatively or in addition, the separator element may be adapted that the consumer can manually adjust the position to control the relative volumes of the compartments.

The separator element typically comprises a separator transverse wall extending across the internal volume of the box. Preferably, the separator transverse wall has a size and shape substantially corresponding to the internal transverse cross-section of the box so that the compartments are completely separated from each other by the separator element.

Preferably, the separator element further comprises a separator front wall, a separator back wall, and separator side walls, all depending from the separator transverse wall. This provides the separator element with a three dimensional form which has good structural rigidity. The separator front wall, separator back wall and separator side walls preferably lie against the inner surfaces of the box front wall, box back wall and box side walls, respectively. The friction between the corresponding surfaces of the separator element and the box provides a certain level of resistance to the sliding of the separator element within the box. The separator element therefore does not slide freely but can be retained in the appropriate position within the box until a force is applied directly or indicated by the consumer.

The separator transverse wall may optionally be provided with a barrier layer on at least one of the top surface and the bottom surface. For example, a layer of a metallic film may be provided on at least one of the top surface or bottom surface of the separator transverse wall. Such a barrier layer may advantageously prevent the migration of odours, flavours, moisture or other liquids and gases between the compartments. This may be particularly beneficial, for example, where the upper compartment is used as a waste compartment for used consumer goods or where the compartments are used to hold different consumer goods having different flavours.

The separator element is preferably formed from a single laminar blank which is folded and inserted inside the box of the container during assembly. The separator element may be formed of the same sheet material as the box, or a different sheet material.

The box of the containers according to the invention is adapted to house the consumer goods. As described above, the top end of the box is at least partially open to provide the top access opening. Preferably, the top end of the box is fully open in order to maximise the size of the top access opening. In such embodiments, the box does not include a box top wall. Preferably, in such embodiments, flaps are provided that depend from the top edge of the side walls into the top access opening. The inclusion of such flaps helps to reduce any gap between the lid and the side walls when the lid is closed over the top access opening. In alternative embodiments, the box may comprise a box top wall and the top access opening may be defined by a cut out in the box top wall. The top access opening therefore only partially extends over the top face of the box.

The top access opening may optionally extend part way down the box front wall. For example, a cut out may be provided at the top edge of the box front wall. This may advantageously improve access to the inside of the box when the lid is open. Alternatively or in addition, it may facilitate the opening of the lid, for example, in embodiments where the lid is tucked behind the box front wall in the closed position, as described below.

In certain embodiments of the present invention, the access opening is incorporated into the container during the manufacturing process and is present when the lid is opened for the first time. In alternative embodiments of the present invention, upon first opening the top access opening is at least partially covered by a removable element which is at least partially removed by the consumer upon first opening of the lid, in order to gain access to the inside of the box.

The lid of the containers according to the invention is hingedly connected to the box back wall so that it can be moved between the open and closed positions. The lid may take any suitable form that enables the top access opening to be covered in the closed lid position.

In certain preferred embodiments of the invention, the lid is a lid flap that comprises a lid top wall for covering the top access opening. In alternative embodiments, the lid may comprise a lid top wall, a lid front wall and lid side walls to form a three dimensional, cup-shaped lid.

Preferably, containers according to the invention further comprise closure means for retaining the lid in the closed lid position. The closure means preferably provides a resealable structure that retains a secure closure before first opening of the container and also enables repeated opening and closing of the lid between uses. The closure means may be provided on the lid, on any part of the box walls that underlie the lid in the closed position, or both.

The closure means may take any suitable form. For example, the closure means may comprise a microsuction structure. The term "microsuction structure" is used herein to refer to an article comprising a flexible material having a plurality of micro cavities on the material's external surface. The walls of the micro cavities are deformable, such that, when the external surface of the material is pressed against a contact surface, a sealed environment of reduced pressure is formed between the walls of the cavities and the contact surface. This provides a suction force between the walls of the cavities and the contact surface. The microsuction structure can therefore provide an effective means for securing the lid flap in the closed position relative to the box. Alternatively, the closure means may comprise a resealable adhesive or a magnetised or magnetizable material in cooperation with one or several magnets provided between the contacting surfaces of the lid and the box.

Alternatively or in addition to any of the closure means described above, the closure means may comprise a closure tab extending from an edge of the lid. The closure tab may be adapted for insertion behind the box front wall in the closed lid position. Alternatively, the box may be provided with a corresponding slit in the box front wall for receiving the closure tab when the lid is in the closed lid position.

Containers according to the invention are preferably formed from one or more folded laminar blanks. The one or more laminar blanks may be formed from any suitable material or combination of materials including, but not limited to, cardboard, paperboard, plastic, metal, or combinations thereof. The different components of the container may be formed from the same material, or from different materials. Particularly preferably, the box and lid of the containers according to the invention are integrally formed from a single laminar blank.

Containers according to the present invention preferably comprise one or more elongate consumer goods within the box. Preferably, the one or more elongate consumer goods are arranged transversely across the box, so that the longitudinal axis of the one or more consumer goods is substantially horizontal. This arrangement is particularly effective with the dispensing means of the present invention, since the transversely aligned consumer goods can be readily supported on the horizontal tray portion and dispensed sideways through the side opening of the box. The arrangement also advantageously facilitates the arrangement of the consumer goods on the dispensing means. After a consumer good has been removed from the container through the dispensing means, the next consumer good will automatically fall onto the dispensing means under gravity. The consumer therefore does not need to take any action to refill the dispensing means, other than the push the tray portion back into the box.

Preferably, containers according to the invention comprise one or more aerosol-generating articles or aerosol-generating article components within the box. As described above, containers according to the invention are particularly suitable for heated aerosol-generating articles that are intended for use in an aerosol-generating device comprising a heater element. After an aerosol-generating article has been dispensed from the box using the dispensing means, the aerosol-generating article can be directly received into the heating chamber of an aerosol-generating device, without the need for the consumer to remove the aerosol-generating article from the container. The insertion of the aerosol-generating article into the aerosol-generating device can therefore conveniently be conducted in a contactless manner, as explained above.

Through an appropriate choice of dimensions, containers according to the invention may be designed to hold different types or numbers of aerosol-generating articles or other consumer goods.

The invention will now be further described, by way of example only, with reference to the accompanying drawings in which.

Figure 1:
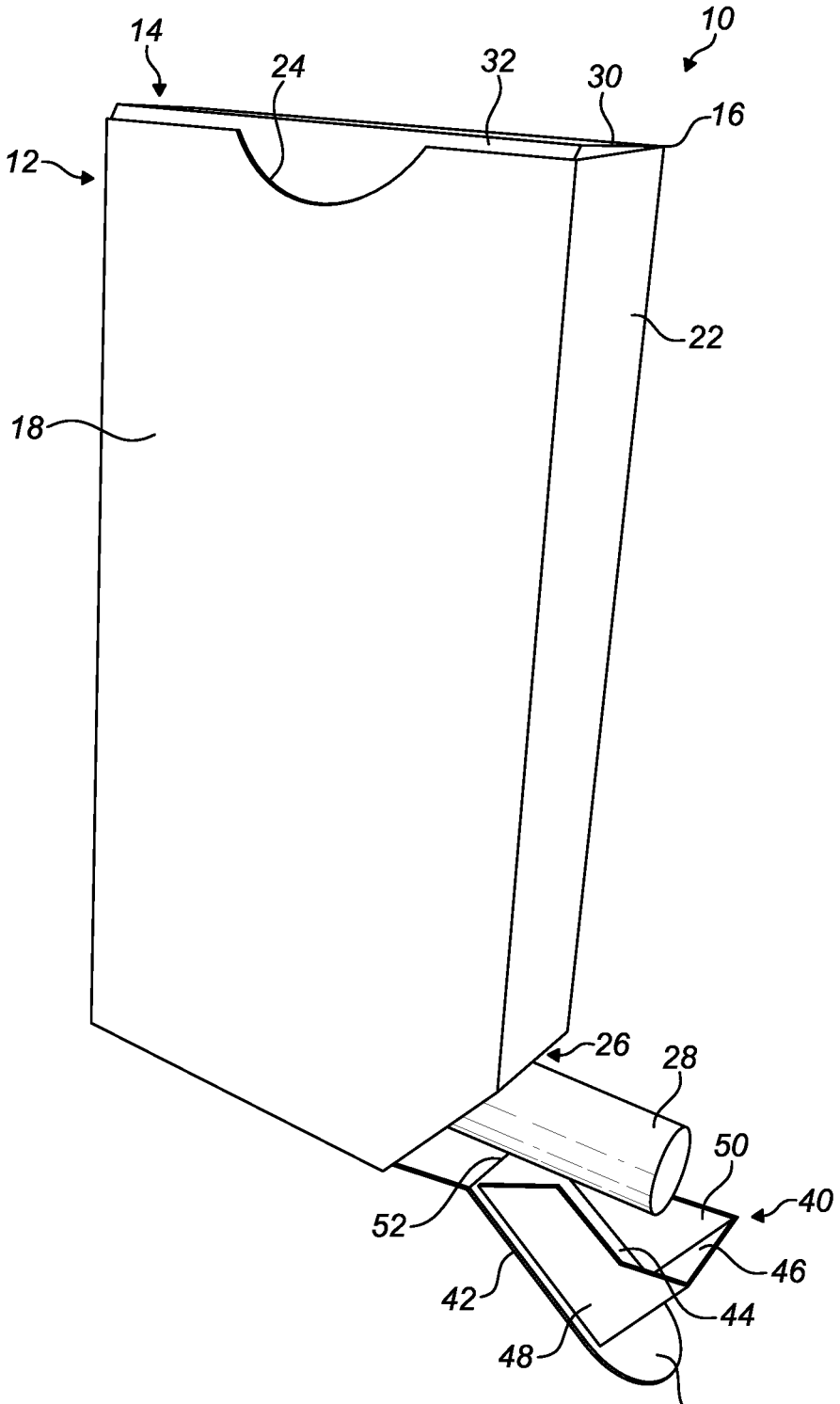
FIG. 1 shows a perspective view of a container according to the invention with the lid in the closed lid position and the dispensing means in the dispensing position.

FIG. 1 shows a container 10 in accordance with the invention, comprising a box 12 and a lid flap 14 connected to the box 12 along a hinge line 16. The box 12 is a rectangular parallelepiped and comprises a box front wall 18, a box back wall, a first box side wall 22, a second box side wall and a box bottom wall. The top end of the box 12 is open to provide the top access opening of the container 10. A semi-circular cut out 24 is provided at the top edge of the box front wall 18, adjacent the top access opening. A side opening 26 is provided at the bottom of the first box side wall 22. The box 12 houses a plurality of aerosol-generating articles 28 which are arranged transversely within the box 12.

The lid flap 14 depends from the top edge of the box back wall and comprises a lid top wall 30 and a closure tab 32 extending from the front edge of the lid top wall 30. FIG. 1 shows the container with the lid flap 14 in the closed lid position, with the lid top wall 30 covering the top access opening of the box 12 and the closure tab 32 inserted behind the box front wall 18 to retain the lid flap 14 in place. The lid flap 14 can be readily moved into an open lid position by contacting the lid flap through the cut out 24 in the box front wall and pulling the lid flap 14 upwards and away from the box 12.

Figure 3:
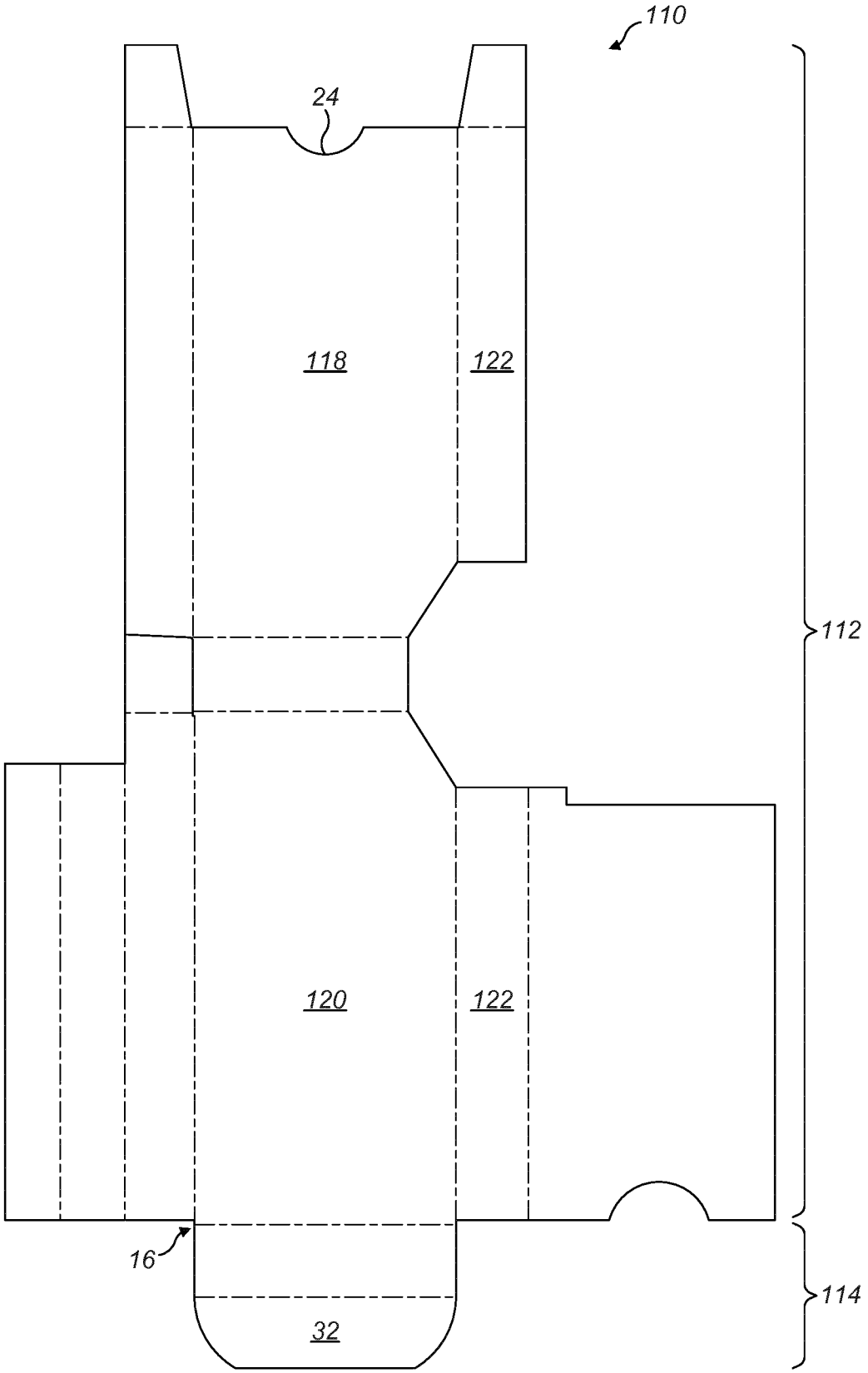
FIG. 3 shows a laminar blank suitable for forming the box and lid flap of the container of FIGS. 1 and 2.

The box 12 and lid flap 14 are integrally formed from a single laminar blank. A suitable laminar blank 110 for forming the box 12 and lid flap 14 is shown in FIG. 3. In FIG. 3, the solid lines indicate cut lines and the dashed lines indicate fold lines.

The blank 110 comprises a box-defining portion 112 for forming the box 12 and a lid-defining portion 114 for forming the lid flap 14, wherein the lid-defining portion 114 is connected to the box-defining portion 112 along the hinge line 16. A first box side wall panel 122 extends from the side edge of each of the box front wall panel 118 and the box back wall panel 120. In the assembled container, the first box side wall panels 122 overlie each other to define the first box side wall 22. Each of the first box side wall panels 122 has a portion cut away from the bottom end to define the side opening in the box 12.

The container 10 further comprises a dispensing means 40 mounted inside the box 12. The dispensing means 40 comprises a tray portion 42 having a tray bottom wall 44 a first tray side wall 46, a second tray side wall (not visible), a tray front wall 48 and a tray back wall 50 extending upwards from the tray bottom wall 44. A hinge line 52 extends across the tray bottom wall 44 between the front edge and the back edge. A first portion of each of the tray front wall 48 and the tray back wall 50 extends along the edges of the tray bottom wall, from the first tray side wall 46 up to the hinge line 52. An increased height portion (not visible) extends from the hinge line 52 to the second tray side wall. The height of the increased height portion of each of the tray front wall 48 and the tray back wall 50 is greater than the height of the side opening in the first box side wall 22. The increased height portions therefore cannot pass through the side opening and prevent the tray portion 42 from being moved beyond the dispensing position shown in FIG. 2. A pull tab 54 extends outwards from the bottom edge of the tray side wall 46.

The tray portion 42 is adapted to support an individual aerosol-generating article 28 on the support surface provided by the tray bottom wall 44. The aerosol-generating articles 28 can therefore be dispensed from the container one at a time.

In the closed position, the dispensing means 40 is positioned fully inside the box 12, with the tray bottom wall 44 supported on the box bottom wall and the first tray side wall 46 covering the side opening 26 of the box. The pull tab 54 extends outwards from the side opening 26. In order to move the dispensing means 40 into the dispensing position shown in FIG. 1, the consumer pulls the pull tab 56 to slide the tray portion 42 outwards through the side opening 26. In the dispensing position, the tray portion 42 protrudes through the side opening 26 and the hinge line 52 is positioned just outside of the box. The end part of the tray portion 42 can therefore be pivoted downwards as shown, to expose the end of the aerosol-generating article 28. The aerosol-generating article 28 can then be removed from the container 10 by the consumer, or inserted directly into an aerosol-generating device.

For example, where the aerosol-generating article 28 is a heated aerosol-generating article, the exposed end of the aerosol-generating article 28 may be inserted into the heating chamber of an aerosol-generating device in a contactless manner, as described above. In particular, the aerosol-generating device can be brought towards the exposed end of the aerosol-generating article 28 and pushed towards the container to insert the aerosol-generating article into the heating chamber. The aerosol-generating article 28 is prevented from moving backwards into the box 12 by the second tray side wall. The presence of the aerosol-generating device adjacent the side opening prevents the end part of the tray portion from pivoting back up to its original position. Once the end of the aerosol-generating article 28 has been inserted into the heating chamber of the aerosol-generating device, the aerosol-generating device with the aerosol-generating article in place can be moved away from the container. This insertion of the aerosol-generating article into the aerosol-generating device can be carried out without the consumer touching the aerosol-generating article.

Figure 4:
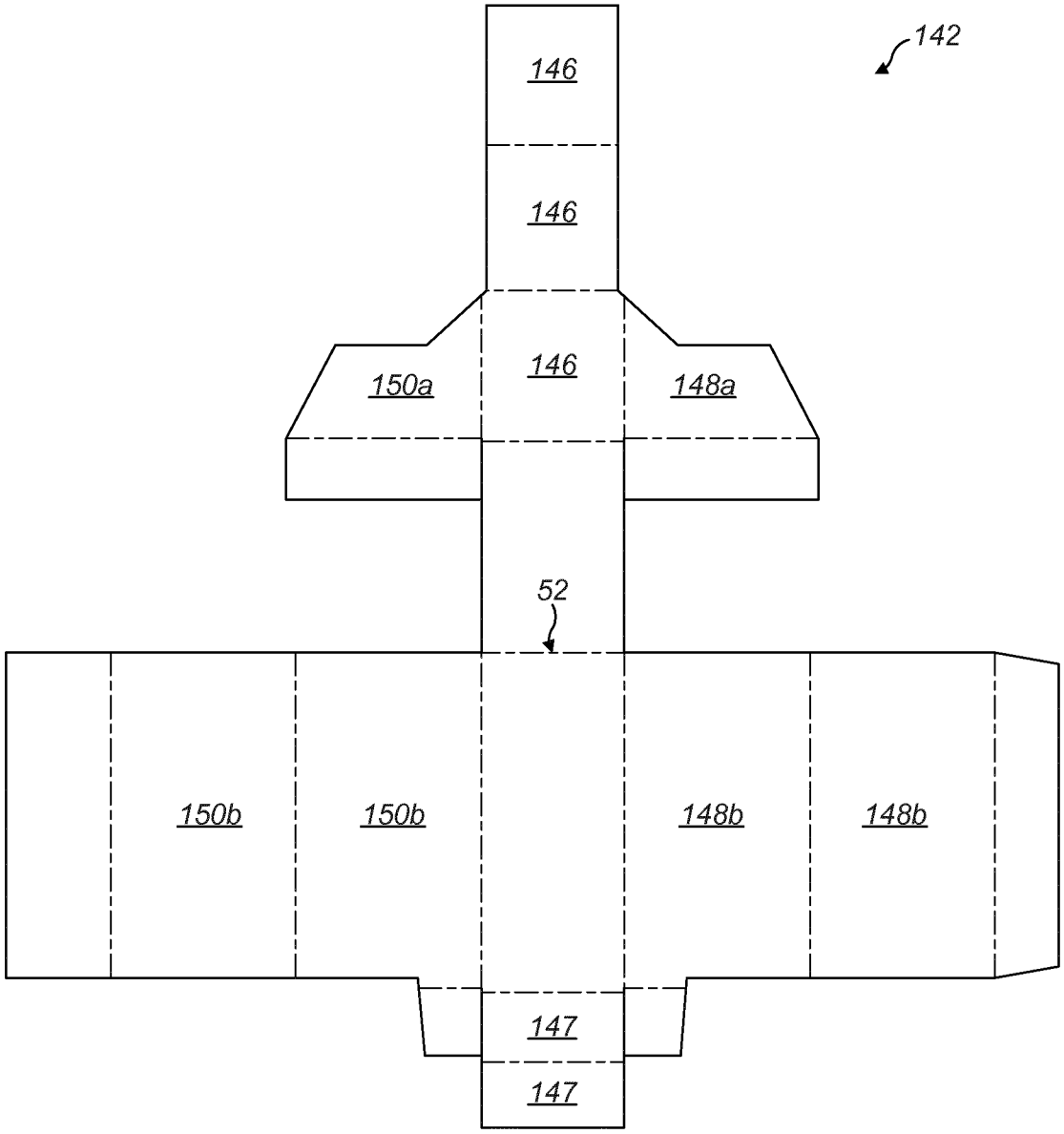
FIG. 4 shows a laminar blank suitable for forming the dispensing means of the container of FIGS. 1 and 2.

The dispensing means 40 can be assembled from a single laminar blank which is folded to form the tray portion 42, and then mounted inside the box 12, against the box bottom wall. A suitable laminar blank 140 for forming the tray portion 42 is shown in FIG. 4. In FIG. 4, the solid lines indicate cut lines and the dashed lines indicate fold lines.

As shown in FIG. 4, the laminar blank 142 comprises a tray bottom wall panel 144 comprising a fold line defining the hinge line 52. The laminar blank 142 includes first tray front wall panels **148*a* for forming the first portion of the tray front wall 48 and first tray back wall panels 150*a* for forming the first portion of the tray back wall 50, as described above. The laminar blank further includes second tray front wall panels 148*b* for forming the increased height portion of the tray front wall 48 and second tray back wall panels 150*b* for forming the increased height portion of the tray back wall 50, as described above. First tray side wall panels 146 are provided at one end of the tray bottom wall panel 144 for forming the first tray side wall 46 and second tray side wall panels 147 are provided at the opposite end of the tray bottom wall panel 144** for forming the tray second side wall.

Figure 2:
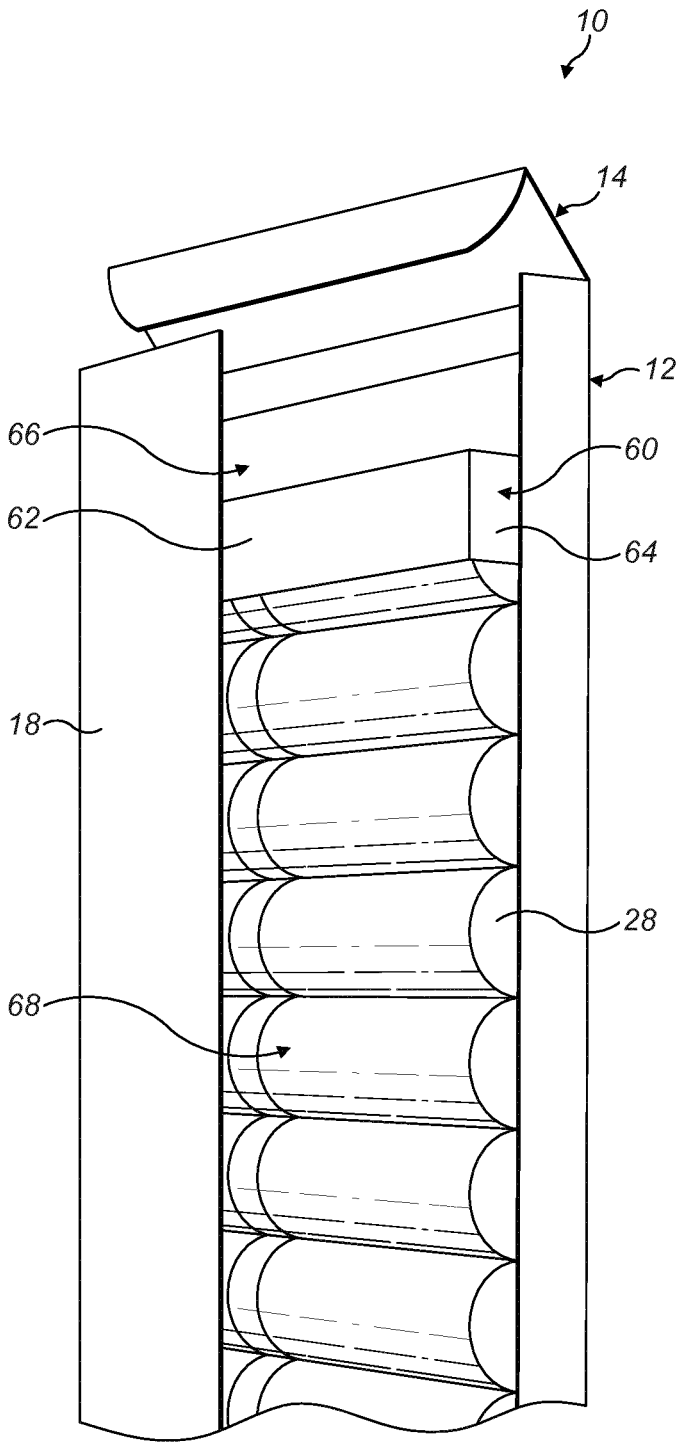
FIG. 2 shows a perspective view of the container of FIG. 1, with a portion of the box front wall and the first box side wall cut away to show the inside of the box.

As shown in FIG. 2, the container 10 further comprises a separator element 60 mounted inside the box 12. The separator element 60 comprises a separator transverse wall extending transversely across the inside of the box 12 and a separator front wall 62, separator back wall and separator side walls 64 extending downwards from the separator transverse wall. The separator element 60 separates the internal volume of the box 12 into an upper compartment 66 and a lower compartment 68. The upper compartment 66 is accessible through the top access opening, by opening the lid flap 14. The upper compartment 66 is initially empty and is intended for the storage of used aerosol-generating articles. The lower compartment 68 houses the plurality of aerosol-generating articles 28, which are dispensed from the lower compartment 68 by means of the dispensing means 40.

The separator element 60 has a transverse cross-section that substantially corresponds to the internal transverse cross-section of the box 12 and the separator element 60 therefore remains in place as a result of friction between the walls of the separator element 60 and the inner surfaces of the corresponding box walls. The separator element 60 is vertically slidable within the box 12 to adjust the relative volumes of the upper compartment 66 and the lower compartment 68. Therefore, the separator element 60 can slide downwards to reduce the size of the lower compartment 66 as the number of aerosol-generating articles 28 within the lower compartment 68 decreases. The size of the upper compartment 66 will accordingly increase so that an increasing number of used aerosol-generating article can be accommodated. The separator element 60 will automatically move downwards to adjust the relative sizes of the compartments as the consumer inserts used aerosol-generating articles into the upper compartment 66.

The invention claimed is:

1. A container for consumer goods, the container comprising:

a box configured to house the consumer goods, the box comprising a box front wall, a box back wall, a box bottom wall, a first box side wall, and a second box side wall, wherein a top face of the box is at least partially open to provide a top access opening providing access to an interior of the box, and wherein the first box side wall comprises a side opening proximate the box bottom wall;

a lid hingedly connected to the box back wall and movable between a closed lid position in which the lid covers the top access opening and an open lid position in which the top access opening is uncovered; and a dispensing means for dispensing one or more consumer goods from the container, the dispensing means comprising a tray portion configured to hold the one or more consumer goods, the tray portion being mounted inside the box such that the tray portion is slidable through the side opening in the first box side wall between a closed position, in which the tray portion is inside the box, and a dispensing position, in which a part of the tray portion protrudes through the side opening such that the one or more consumer goods within the tray portion can be removed, wherein the tray portion comprises a tray bottom wall and a hinge line provided on the tray bottom wall, the hinge line extending between a front edge and a back edge of the tray bottom wall, and wherein when in the dispensing position, the hinge line is outside of the box such that an end part of the tray bottom wall protruding through the side opening is pivotable in a downwards direction relative to the box.

2. The container according to claim 1, wherein the tray portion further comprises a first tray side wall, and wherein in the closed position of the dispensing means, the first tray side wall covers the side opening of the box.

3. The container according to claim 1, wherein the tray portion further comprises a second tray side wall at a side of the tray portion that is opposite the side opening, and wherein in the open position of the dispensing means the second tray side wall remains inside the box to restrict movement of the one or more consumer goods on the tray portion of the dispensing means back into the box.

4. The container according to claim 1, wherein the dispensing means further comprises retention means for preventing movement of the tray portion beyond the dispensing position.

5. The container according to claim 4, wherein the tray portion further comprises a tray front wall and a tray back wall, wherein at least one of the tray front wall and the tray back wall comprises an increased height portion having a height that is larger than a height of the side opening, wherein the increased height portion is configured to move towards the first box side wall as the tray portion is moved towards the dispensing position, and wherein the increased height portion abuts the first box side wall when the tray portion reaches the dispensing position to prevent the movement of the tray portion beyond the dispensing position.

6. The container according to claim 1, wherein the dispensing means further comprises a pull tab extending from the tray portion such that in the closed position of the dispensing means, the pull tab protrudes through the side opening.

7. The container according to claim 1, wherein the side opening is provided at a bottom edge of the first side wall, and wherein the tray portion is slidable along an inner surface of the box bottom wall.

8. The container according to claim 1, wherein in the dispensing position, the tray portion protrudes through the side opening by a distance corresponding to at least one third of a distance between the first box side wall and the second box side wall.

9. The container according to claim 1, wherein the dispensing means is configured to dispense an individual consumer good.

10. The container according to claim 1, further comprising a separator element mounted within the box, wherein the separator element separates an internal volume of the box into an upper compartment, which is accessible through the top access opening and a lower compartment containing the consumer goods, and wherein the consumer goods are dispensed from the lower compartment by the dispensing means.

11. The container according to claim 10, wherein the separator element is slidable within the box to adjust relative volumes of the upper compartment and the lower compartment.

12. The container according to claim 10, wherein the separator element comprises a separator transverse wall extending across the internal volume of the box and a separator front wall, a separator back wall, and separator side walls, depending from the separator transverse wall, and wherein the separator front wall, the separator back wall, and the separator side walls lie against an inner surface of the box front wall, the box back wall, and the box side walls, respectively.

13. The container according to claim 12, wherein a barrier layer is provided on at least one surface of the separator transverse wall.

14. The container according to claim 1, wherein the box contains a plurality of aerosol-generating articles, wherein the plurality of aerosol-generating articles are transversely arranged, with a longitudinal axis of each aerosol-generating article extending horizontally, and wherein the dispensing means is configured to dispense an individual aerosol-generating article.

* * * * *